United States Patent [19]

Oda et al.

[11] 4,319,969

[45] Mar. 16, 1982

[54] AQUEOUS ALKALI METAL CHLORIDE ELECTROLYTIC CELL

[75] Inventors: Yoshio Oda; Takeshi Morimoto; Kohji Suzuki, all of Yokohama, Japan

[73] Assignee: Asahi Glass Company, Ltd., Tokyo, Japan

[21] Appl. No.: 177,896

[22] Filed: Aug. 14, 1980

[30] Foreign Application Priority Data

Aug. 31, 1979 [JP] Japan ..... 54-110234

[51] Int. Cl.[3] ..... C25B 1/16; C25B 1/26; C25B 9/00; C25B 11/03

[52] U.S. Cl. ..... 204/98; 204/128; 204/252; 204/283; 204/290 R; 204/296; 204/292; 427/126.5; 427/282

[58] Field of Search ..... 204/252, 283–284, 204/290 R, 296, 98, 128, 292; 427/282, 126.5, 245

[56] References Cited

U.S. PATENT DOCUMENTS

| | | | |
|---|---|---|---|
| 4,101,395 | 7/1978 | Motani et al. | 204/283 X |
| 4,126,588 | 11/1978 | Ukihashi et al. | 204/296 X |
| 4,185,131 | 1/1980 | Goller et al. | 427/282 X |
| 4,206,022 | 6/1980 | Gunjima et al. | 204/296 X |
| 4,224,121 | 9/1980 | Dempsey et al. | 204/283 X |
| 4,229,490 | 10/1980 | Frank et al. | 427/282 X |

*Primary Examiner*—Delbert E. Gantz
*Assistant Examiner*—Donald R. Valentine
*Attorney, Agent, or Firm*—Oblon, Fisher, Spivak, McClelland & Maier

[57] ABSTRACT

An electrolytic cell has a gas-liquid permeable porous electrode layer on a cation exchange membrane. The electrode layer is formed by printing a paste comprising an electrode powder on the surface of said cation exchange membrane by a screen printing process and bonding it.

8 Claims, No Drawings

AQUEOUS ALKALI METAL CHLORIDE ELECTROLYTIC CELL

BACKGROUND OF THE INVENTION

1. Field of the Invention

The present invention relates to an electrolytic cell having a cation exchange membrane. More particularly, it relates to an electrolytic cell which is formed by bonding a porous, gas-liquid permeable, electrode layer to a cation exchange membrane and is suitable for an electrolysis of an aqueous solution of an alkali metal chloride.

2. Description of the Prior Art

As a process for producing an alkali metal hydroxide by an electrolysis of an aqueous solution of an alkali metal chloride, a diaphragm method has been mainly employed instead of a mercury method in view of a prevention of a public pollution.

It has been proposed to use an ion exchange membrane in place of asbestos as a diaphragm to produce an alkali metal hydroxide by electrolyzing an aqueous solution of an alkali metal chloride so as to obtain an alkali metal hydroxide having high purity and high concentration.

On the other hand, it has been proposed to save energy in the world. From the viewpoint, it has been required to minimize a cell voltage in such technology.

It has been proposed to attain an electrolysis by a so-called solid polymer electrolyte type electrolysis of an alkali metal chloride wherein a cation exchange membrane of a fluorinated polymer is bonded with gas-liquid permeable catalytic anode on one surface and a gas-liquid permeable catalytic cathode on the other surface of the membrane (British Pat. No. 2,009,795). This method is remarkably advantageous as an electrolysis at a lower cell voltage because an electric resistance caused by an electrolyte and an electric resistance caused by bubbles of hydrogen gas and chlorine gas generated in the electrolysis, can be remarkably decreased which have been considered to be difficult to reduce in the electrolysis.

The contact of the gas-liquid permeable porous electrode with the cation exchange membrane is an important factor for the efficiency of the electrolytic cell in such solid polymer electrolyte type cation exchange membrane electrolytic cell. When a thickness of an electrode is non-uniform or a contact between the electrode with the cation exchange membrane is not satisfactory, a part of the electrode is easily peeled off whereby a cell voltage increases or the gas and the solution remain in the interfaces to cause the increase of the cell voltage. The desired advantages of the electrolytic cell are decreased or lost.

SUMMARY OF THE INVENTION

It is an object of the present invention to provide a cation exchange membrane type electrolytic cell having excellent characteristics which is formed by bonding electrodes having an uniform thickness to a cation exchange membrane without any gap by novel means for bonding the gas-liquid permeable porous electrode to the cation exchange membrane.

The foregoing and other objects of the present invention have been attained by providing a cation exchange membrane type electrolytic cell which is formed by bonding each gas-liquid permeable porous electrode to a cation exchange membrane by a screen printing process using a paste comprising an electrode powder.

DETAILED DESCRIPTION OF THE PREFERRED EMBODIMENTS

In the screen printing process for bonding the electrode layer to the cation exchange membrane, a paste comprising an eletrode powder is used.

The electrodes can be formed by any material for the anode and the cathode. The anode is preferably formed by one or more platinum group metal such as platinum, ruthenium, rhodium, and iridium and electroconductive oxides thereof, and electroconductive reduced oxides thereof. The cathode is preferably formed by one or more of iron, nickel, stainless steel, a thermally decomposed product of a fatty acid nickel salt, Raney nickel, stabilized Raney nickel, carbonyl nickel and carbon powder supporting a platinum group metal.

The electrode powder is incorporated in the paste in a form of a powder having a particle diameter of 0.01 to 300μ especially 0.1 to 100μ. A hydrophobic polymer is preferably incorporated in the paste. The hydrophobic polymer is used as a binder for the electrode and the cation exchange membrane. Suitable hydrophobic polymers include fluorocarbon polymers such as polytetrafluoroethylene and polyhexylfluoroethylene. The hydrophobic polymer having a particle diameter of 0.1 to 500μ especially 0.1 to 100μ is preferably incorporated so as to be thoroughly dispersed in the paste. In order to improve the dispersibility, it is preferable to incorporate a long chain hydrocarbon type surfactant or a fluorinated hydrocarbon type surfactant at a desired ratio.

The contents of the electrode powder and the hydrophobic polymer in the paste are depending upon characteristics of the electrode. The former is preferably in a range of 20 to 95 wt.% especially 40 to 90 wt.%. The latter is preferably in a range of 0.1 to 80 wt.% especially 1 to 60 wt.%. The viscosity of the paste comprising the electrode powder is preferably controlled in a range of 1 to $10^5$ poises especially 10 to $10^4$ poises before the screen printing. The viscosity can be controlled by selecting particle sizes and contents of the electrode powder and the hydrophobic polymer and a content of water as the medium and preferably controlled in said range by incorporating a viscosity regulating agent.

The viscosity regulating agents can be water soluble viscous materials which are gradually soluble in water. Suitable viscosity regulating agents include cellulose type materials such as carboxymethyl cellulose, methyl cellulose, hydroxyethyl cellulose, and cellulose and polyethyleneglycol, polyvinyl alcohol, polyvinyl pyrrolidone, sodium polyacrylate and polymethyl vinyl ether. The property of the electrode may not deteriorate by the incorporation of the viscosity regulating agent because of its water solubility. It is also possible to use any material which does not deteriorate electrolytic characteristics by a reaction or corrosion of the electrode layer in the preparation and the use of the electrode layer, such as casein and polyacrylamide.

The paste is printed on and bonded to the surface of the cation exchange membrane by the screen printing process. The conventional screen printing process can be employed. It is preferable to use a screen having mesh number of 10 to 2400 especially mesh number of 150 to 1000 and a thickness of 2 mm to 4μ especially 300μ to 8μ. When the mesh is too large, the clogging of the screen is caused to be non-uniform printing. When the mesh is too small, excess of the paste is printed.

When the thickness is too thick, non-uniform printing is caused. When the thickness is too thin, a printing for a desired amount of the paste is not attained. A screen mask is used for foming the electrode layer having a desired size and configuration on the surface of the cation exchange membrane. The configuration is preferably a printed pattern eliminating the configuration of the electrode. The thickness of screen mask is preferably in a range of 1 to 500μ. The substances for the screen and the screen mask can be any materials having satisfactory strength such as stainless steel, polyethyleneterephthalate and nylon for the screen and epoxy resins for the screen mask.

A screen and the screen mask are placed on the cation exchange membrane for the printing of the electrode layer. The paste is fed on the screen and is printed under a desired pressure by squeeze whereby the electrode layer having the configuration beside the screen mask, is formed on the surface of the cation exchange membrane. The thickness of the electrode layer on the cation exchange membrane is depending upon a thickness of the screen, a viscosity of the paste and a mesh number of the screen. It is preferable to control the thickness of the screen, the visosity of the paste and the mesh of the screen so as to give the thickness of the electrode ranging from 0.1 to 100μ especially 1 to 50μ.

The gap between the screen and the cation exchange membrane and the material of the squeeze and the pressure applied to mesh by the squeeze in the screen printing process, highly relate to the physical properties, thickness and uniformity of the electrode layer formed on the surface of the cation exchange membrane. In order to give desired printing, the gap between the screen and the cation exchange membrane is set depending upon the kind and viscosity of the paste preferably ranging from 0.5 mm to 5 cm, and the hardness of the squeeze having sharp corner is selected according to the viscosity of the paste preferably ranging from 50 to 100 shore hardness, and the uniform pressure of the squeeze is applied to the mesh. Thus the electrode layer having uniform thickness is formed on one or both of the surface of the cation exchange membrane in a high bonding strength. Thereafter it is preferable to press the electrode layer on the surface of the cation exchange membrane at 100° to 300° C. especially 110° to 250° C. under a pressure of 5 to 1000 kg/cm$^2$ especially 20 to 500 kg/cm$^2$, whereby a strongly bonded structure of the electrode layer and the cation exchange membrane can be obtained.

The electrode layer formed on the cation exchange membrane should be a gas permeable porous layer. The average pore diameter is preferably in a range of 0.01 to 50μ especially 0.1 to 30μ. The porosity is preferably in a range of 10 to 99% especially 20 to 95%. The thickness is preferably in a range of 0.1 to 100μ especially 1 to 50μ.

The cation exchange membrane on which the electrode layer is formed, can be made of a polymer having cation exchange groups such as carboxylic acid groups, sulfonic acid groups, phosphoric acid groups and phenolic hydroxy groups. Suitable polymers include copolymers of a vinyl monomer such as tetrafluoroethylene and chlorotriluoroethylene and a perfluorovinyl monomer having an ion-exchange group such as sulfonic acid group, carboxylic acid group and phosphoric acid group or a reactive group which can be converted into the ion-exchange group. It is also possible to use a membrane of a polymer of trifluoroethylene in which ion-exchange groups such as sulfonic acid group are introduced or a polymer of styrene-divinyl benzene in which sulfonic acid groups are introduced.

The cation exchange membrane is preferably made of a fluorinated polymer having the following units (M) $\left(CF_2-CXX'\right)$ (M mole %)

(N) $\left(CF_2-\underset{\underset{Y}{|}}{C}X\right)$ (N mole %)

wherein X represents fluorine, chlorine or hydrogen atom or $-CF_3$; X' represents X or $CF_3(CF_2)_m$; m represents an integer of 1 to 5.

The typical examples of Y have the structures bonding A to a fluorocarbon group such as $$\left(CF_2\right)_x A,\ -O\left(CF_2\right)_x A,\ \left(O-CF_2-\underset{\underset{Z}{|}}{C}F\right)_y A,$$

$$-CF_2\left(O-CF_2-\underset{\underset{Z}{|}}{C}F\right)_y A,$$

$$\left(O-CF_2-\underset{\underset{Z}{|}}{C}F\right)\left(O-CF_2-\underset{\underset{Rf}{|}}{C}F\right)_y A \text{ and}$$

$$-O-CF_2\left(\underset{\underset{Z}{|}}{C}F-O-CF_2\right)_x\left(CF_2\right)_y\left(CF_2-O-\underset{\underset{Rf}{|}}{C}F\right)_z A$$

x, y and z respectively represent an integer of 1 to 10; Z and Rf represent -F or a $C_1$–$C_{10}$ perfluoroalkyl group; and A represents —COOM or $-SO_3M$, or a functional group which is convertible into —COOM or $-SO_3M$ by a hydrolysis or a neutralization such as —CN, —COF, $-COOR_1$, $-SO_2F$, $-CONR_2R_3$ and $-SO_2NR_2R_3$ and M represents hydrogen or an alkali metal atom; $R_1$ represents a $C_1$–$C_{10}$ alkyl group; $R_2$ and $R_3$ represent H or a $C_1$–$C_{10}$ alkyl group.

It is preferable to use a fluorinated cation exchange membrane having a ion exchange group content of 0.5 to 4.0 especially 1.0 to 20 meq/g. dry resin which is made of said copolymer, since the desired objects of the present invention are attained in stable condition and high degree especially excellent durability for a long time.

In the preparation of such perfluoro polymer, one or more monomers for forming the units (M) and (N) can be used, if necessary, with a third monomer so as to improve the membrane. For example, a flexibility of the membrane can be imparted by incorporating $CF_2=CFORf$ (Rf is a $C_1$–$C_{10}$ perfluoroalkyl group), or a mechanical strength of the membrane can be improved by crosslinking the copolymer with a divinyl monomer such as $CF_2=CF-CF=CF_2$ or
$CF_2=CFO(CF_2)_{1\text{-}3}CF=CF_2$.

The copolymerization of the fluorinated olefin monomer and a monomer having carboxylic acid group or a functional group which is convertible into carboxylic acid group, if necessary, the other monomer can be carried out by a desired conventional process. The polymerization can be carried out if necessary, using a solvent such as halohydrocarbons by a catalytic polymerization, a thermal polymerization or a radiation-induced polymerization. A fabrication of the ion exchange membrane from the resulting copolymer is not critical, for example it can be known-methods such as a press-molding method, a roll-molding method, an extrusion-molding method, a solution spreading method, a dispersion molding method and a powder molding method.

The thickness of the membrane is preferably 20 to 1000 microns especially 50 to 400 microns.

When the functional groups of the cation exchange membrane are groups which are not carboxylic acid groups or sulfonic acid groups, but are convertible to carboxylic acid groups or sulfonic acid groups such as —CN, —COF, —$COOR_1$, —$SO_2F$, —$CONR_2R_3$, —$SO_2NR_2R_3$ ($R_1$ to $R_3$ are defined above), the functional groups are converted to carboxylic acid groups or sulfonic acid groups by a hydrolysis or neutralization with an acid or an alcoholic solution of a base or by reacting $COF_2$ with double bonds as the functional groups before the hydrolysis.

When the cation exchange membrane having carboxylic acid groups is used, the screen printing and bonding of the electrode layer on the surface of the cation exchange membrane is preferably carried out in the condition of the functional groups having the formula —COOL (L represents hydrogen atom or a lower alkyl group) whereby the bonding of the electrode layer to the cation exchange membrane is especially improved in the heat-bonding whereby the electrolytic cell having excellent characteristics can be obtained.

The cation exchange membrane used in the present invention can be fabricated by blending a polyolefin such as polyethylene, polypropylene, preferably a fluorinated polymer such as polytetrafluoroethylene and a copolymer of ethylene and tetrafluoroethylene.

The membrane can be reinforced by supporting said copolymer on a fabric such as a woven fabric or a net, a non-woven fabric or a porous film made of said polymer or wires, a net or a perforated plate made of a metal. The weight of the polymers for the blend or the support is not considered in the measurement of the ion exchange capacity.

In the preparation of an alkali metal hydroxide by the electrolysis of an aqueous solution of an alkali metal chloride in the electrolytic cell of the present invention, an aqueous solution of an alkali metal chloride is fed into the anode compartment partitioned by the cation exchange membrane and water is fed into the cathode compartment. Sodium chloride is usually used as the alkali metal chloride. It is also possible to use the other alkali metal chloride such as potassium chloride and lithium chloride. The corresponding alkali metal hydroxide can be produced from the aqueous solution in high efficiency and a stable condition for a long time.

The electrolytic cell using the cation exchange membrane having the electrode layers can be a unipolar or bipolar type electrolytic cell.

As a material for the electrolytic cell, a material which is resistant to an aqueous solution of an alkali metal chloride and chlorine such as titanium is used for the anode compartment and a material which is resistant to an alkali metal hydroxide having high concentration and hydrogen such as iron, stainless steel or nickel is used for the cathode compartment in an electrolysis of an alkali metal chloride.

When the porous electrodes are used in the present invention, each current collector for feeding the current is placed at the outside of each electrode. The current collectors usually have the same or higher overvoltage for chlorine or hydrogen in comparison with that of the electrodes. For example, the current collector at the anode side is made of a precious metal or a valve metal coated with a precious metal or oxide thereof and the current collector at the cathode side is made of nickel, stainless steel or expanded metal in a form of a mesh or a net. The current collectors are brought into contact with the porous electrodes under a pressure.

In the present invention, the process condition for the electrolysis of an aqueous solution of an alkali metal chloride can be the known condition in the prior arts as British Pat. No. 2,009,795.

For example, an aqueous solution of an alkali metal chloride (2.5 to 5.0 Normal) is fed into the anode compartment and water or a dilute solution of an alkali metal hydroxide is fed into the cathode compartment and the electrolysis is preferably carried out at 80° to 120° C. and a current density of 10 to 100 $A/dm^2$.

The process for producing the alkali metal hydroxide and chlorine by the electrolysis of the aqueous solution of the alkali metal chloride has been illustrated. The present invention is not limited to the embodiment and can be also applied for the preparation of the cells for an electrolysis of water, an electrolysis of a desired alkali metal salt such as sodium sulfate and a fuel cell.

The present invention will be further illustrated by certain examples and references which are provided for purposes of illustration only and are not intended to limit the present invention.

EXAMPLE 1

Into 95 wt. parts of water, 1 wt. parts of carboxymethyl cellulose (hereinafter referring to as CMC) and 5 wt. parts of polyvinyl alcohol (hereinafter referring to as PVA) were dissolved at 80° C. to prepare a viscous solution. 35 wt. parts of 60 wt.% aqueous dispersion of polytetrafluoroethylene (hereinafter referring to as PTFE) having a particle diameter of less than 1μ and 200 wt. parts of platinum black powder having a particle diameter of less than 25μ were added into the viscous solution and the mixture was kneaded to obtain Paste 1.

The Paste 1 was printed in a size of 20 cm×25 cm by a screen printing process using a stainless steel screen having a mesh number of 200 and a thickness of 60μ and a printing plate with a screen mask having a thickness of 8μ and a polyurethane squeeze, on one surface of a cation exchange membrane having a cation exchange capacity of 1.45 meq/g. resin and a thickness of 250μ which is made of a copolymer of $CF_2{=}CF_2$ and $CF_2{=}CFO(CF_2)_3COOCH_3$. The printed layer on the cation exchange membrane was dried in air to solidify the paste as the anode. The resulting anode had a thickness of about 14μ and contained Pt at a ratio of 3 $mg/cm^2$.

On the other hand, the viscous solution was admixed with 35 wt. parts of 60 wt.% aqueous dispersion of PTFE having a particle diameter of less than 1μ and 200 wt. parts of stabilized Raney nickel powder having a particle diameter of less than 25μ made by partial oxidizing Raney Ni particle after the dissolution aluminum with base so as to obtain Paste 2.

The Paste 2 was printed in a size of 20 cm×25 cm by a screen printing process using a stainless steel screen having a mesh number of 200 and a thickness of 80μ and a printing plate with a screen mask having a thickness of 30μ and a polyurethane squeeze, on the other surface of the cation exchange membrane. The printed layer was dried in air to solidify the paste as the cathode. The resulting cathode had a thickness of 35μ and contained Ni at a ratio of 7 mg/cm². The printed layers were bonded to the cation exchange membrane at 150° C. under a pressure of 25 kg/cm². The product was dipped into 25% aqueous solution of sodium hydroxide at 90° C. for 16 hours to hydrolyze the cation exchange membrane and to remove CMC and PVA.

Each platinum mesh as a current collector was brought into contact with each of the cathode and the anode to form an electrolytic cell.

An electrolysis was carried out under maintaining 4 Normal of a concentration of sodium chloride in the anode compartment and maintaining 35 wt.% of a concentration of sodium hydroxide as the catholyte by feeding water into the cathode compartment. The results are as follows.

| Current density (A/dm²) | Cell voltage (V) |
|---|---|
| 10 | 2.65 |
| 20 | 2.87 |
| 30 | 3.05 |
| 40 | 3.19 |

The current efficiency for producing sodium hydroxide at a current density of 20 A/dm² was 95%. When the electrolysis at 20 A/dm² was continued for one month, the cell voltage was substantially constant and any peeling-off of the electrodes from the cation exchange membrane was not found.

EXAMPLE 2

In accordance with the process of Example 1 except using a viscous solution produced by dissolving 1 wt. part of CMC in 50 wt. parts of ethyleneglycol at 100° C., electrodes were bonded to the cation exchange membrane, and the electrolysis was carried out in the same condition. The results are as follows.

| Current density (A/dm²) | Cell voltage (V) |
|---|---|
| 10 | 2.67 |
| 20 | 2.89 |
| 30 | 3.07 |
| 40 | 3.21 |

The current efficiency for producing sodium hydroxide at a current density of 20 A/dm² was 94%.

EXAMPLE 3

In accordance with the process of Example 1 except using a viscous solution produced by dissolving 10 wt. parts of PVA and 20 wt. parts of polyvinylpyrrolidone in 100 wt. parts of water at 80° C., electrodes were bonded to the cation exchange membrane and the electrolysis was carried out in the same condition. The results are as follows.

| Current density (A/dm²) | Cell voltage (V) |
|---|---|
| 10 | 2.68 |
| 20 | 2.92 |
| 30 | 3.07 |
| 40 | 3.22 |

The current efficiency for producing sodium hydroxide at a current density of 20 A/dm² was 94%.

EXAMPLE 4

In accordance with the process of Example 1 except using a mixture of platinum black powder and iridium black powder (atomic ratio of 70:30) having a particle diameter of less than 25μ instead of platinum black powder in the anode, electrodes were bonded to the cation exchange membrane and the electrolysis was carried out in the same condition. The results are as follows.

| Current density (A/dm²) | Cell voltage (V) |
|---|---|
| 10 | 2.66 |
| 20 | 2.89 |
| 30 | 3.06 |
| 40 | 3.20 |

The current efficiency for producing sodium hydroxide at a current density of 20 A/dm² was 94%.

EXAMPLE 5

In accordance with the process of Example 1 except using a stainless steel scrren printing plate having a mesh of 400 and a thickness of 52μ to print on the cation exchange membrane by the screen printing, electrodes were bonded to the cation exchange membrane. The anode had a thickness of about 9μ and contained platinum at a ratio of 2 mg/cm².

In accordance with the process of Example 1, the electrolysis was carried out in the same condition. The results were as follows.

| Current density (A/dm²) | Cell voltage (V) |
|---|---|
| 10 | 2.67 |
| 20 | 2.90 |
| 30 | 3.07 |
| 40 | 3.21 |

The current efficiency for producing sodium hydrate at a current density of 20 A/dm² was 94%.

EXAMPLE 6

In accordance with the process of Example 1 except using the following pastes for the anode and the cathode, electrodes were bonded to the cation exchange membrane.

The paste for the anode was prepared by kneading the mixture of 70 wt. parts of platinum black powder having a particle diameter of less than 25μ and 30 wt. parts of 20 wt.% aqueous dispersion of PTFE having a particle diameter of less than 25μ.

The paste for the cathode was prepared by kneading the mixture of 75 wt. parts of stabilized Raney nickel having a particle diameter of less than 25μ and 25 wt. parts of 30 wt.% aqueous dispersion of PTFE having a particle diameter of less than 1μ.

In accordance with the process of Example 1, the electrolysis was carried out in the same condition. The results are as follows.

| Current density ($A/dm^2$) | Cell voltage (V) |
|---|---|
| 10 | 2.64 |
| 20 | 2.85 |
| 30 | 3.03 |
| 40 | 3.17 |

The current efficiency for producing sodium hydroxide at a current density of 20 $A/dm^2$ was 95%.

EXAMPLE 7

In accordance with the process of Example 1 except that polytetrafluoroethylene having a particle diameter of less than 1μ was not incorporated in the paste, electrodes were bonded to the cation exchange membrane and the electrolysis was carried out in the same condition. The results are as follows.

| Current density ($A/dm^2$) | Cell voltage (V) |
|---|---|
| 10 | 2.64 |
| 20 | 2.85 |
| 30 | 3.03 |
| 40 | 3.16 |

The current efficiency for producing sodium hydrate at a current density of 20 $A/dm^2$ was 93%.

EXAMPLE 8

In accordance with the process of Example 1 except using a cation exchange membrane made of a copolymer of $CF_2{=}CF_2$ and $CF_2{=}CFOCF_2CF(CF_3)OCF_2CF_2SO_2F$ (ion exchange capacity of 0.87 meq/g. dry resin and thickness of 300μ), electrodes were bonded to the cation exchange membrane and the electrolysis was carried out in the same condition. The results are as follows.

| Current density ($A/dm^2$) | Cell voltage (V) |
|---|---|
| 10 | 2.75 |
| 20 | 3.00 |
| 30 | 3.21 |
| 40 | 3.35 |

The current efficiency for producing sodium hydrate at a current density of 20 $A/dm^2$ was 84%.

We claim:

1. An electrolytic cell having a gas-liquid permeable porous electrode layer on a cation exchange membrane, wherein said electrode layer is formed by screen printing a paste comprising a hydrophobic polymer and an electrode powder on the surface of said cation exchange membrane, wherein said electrode powder is a metal, an electroconductive metal oxide, or an electroconductive reduced metal oxide powder, and bonding said paste to said membrane by the application of heat and pressure.

2. The electrolytic cell according to claim 1 wherein said electrode layer is an anode and said electrode powder for said anode is made of a platinum group metal or an electric conductive oxide thereof or an electric conductive reduced oxide thereof.

3. The electrolytic cell according to claim 1 wherein said electrode layer is a cathode and said electrode powder for said cathode is made of a platinum group metal or an electric conductive oxide thereof or an iron group metal.

4. The electrolytic cell according to claim 1 wherein said electrode layer has a porosity of 10 to 99% and a thickness of 0.1 to 100μ.

5. The electrolytic cell according to claim 1 or 3 wherein said screen has a mesh number of 10 to 2400 and a thickness of 2 mm to 4μ.

6. The electrolytic cell according to claim 1, 3 or 4 wherein said cation exchange membrane is made of a fluorinated polymer having carboxylic acid groups or sulfonic acid groups.

7. The electrolytic cell according to claim 6 wherein said cation exchange membrane is made of a copolymer having the units (M) $\leftarrow CF_2-CXX' \rightarrow$ (M mole %)

(N) $\leftarrow CF_2-\underset{\underset{Y}{|}}{CX} \rightarrow$ (N mole %)

wherein X represents fluorine, chlorine or hydrogen atom or $-CF_3$; X' represents X or $CF_3(CF_2)_m$; m represents an integer of 1 to 5; Y represents the following unit;

$$\leftarrow CF_2 \rightarrow_x A,\ -O\leftarrow CF_2 \rightarrow_x A,\ \leftarrow O-CF_2-\underset{\underset{Z}{|}}{CF} \rightarrow_y A,$$

$$-CF_2\leftarrow O-CF_2-\underset{\underset{Z}{|}}{CF} \rightarrow_y A,$$

$$\leftarrow O-CF_2-\underset{\underset{Z}{|}}{CF} \rightarrow \leftarrow O-CF_2-\underset{\underset{Rf}{|}}{CF} \rightarrow_y A \text{ and}$$

$$-O-CF_2\leftarrow \underset{\underset{Z}{|}}{CF}-O-CF_2 \rightarrow_x \leftarrow CF_2 \rightarrow_y \leftarrow CF_2-O-\underset{\underset{Rf}{|}}{CF} \rightarrow_z A$$

x, y and z respectively represent an integer of 1 to 10; Z and Rf represent —F or $C_1$–$C_{10}$ perfluoroalkyl group; and A represents —COOM or $-SO_3M$ or a functional group which is convertible into —COOM or $-SO_3M$ by a hydrolysis or a neutralization such as —CN, —COF, $-COOR_1$, $-SO_2F$, $-CONR_2R_3$ and $-SO_2NR_2R_3$ and M represents hydrogen or an alkali metal atom; $R_1$ represents a $C_1$–$C_{10}$ alkyl group; $R_2$ and $R_3$ represent H or a $C_1$–$C_{10}$ alkyl group.

8. The electrolytic cell according to claim 1, which is used for producing an alkali metal hydroxide and chlorine by an electrolysis of an aqueous solution of an alkali metal chloride.

* * * * *